US009135881B2

(12) United States Patent
Guo et al.

(10) Patent No.: US 9,135,881 B2
(45) Date of Patent: Sep. 15, 2015

(54) LCD PANEL DRIVER CIRCUIT, DRIVING METHOD AND LCD DEVICE

(71) Applicant: SHENZHEN CHINA STAR OPTOELECTRONICS TECHNOLOGY CO., LTD, Shenzhen (CN)

(72) Inventors: Dongsheng Guo, Shenzhen (CN); Jiang Zhu, Shenzhen (CN)

( * ) Notice: Subject to any disclaimer, the term of this patent is extended or adjusted under 35 U.S.C. 154(b) by 294 days.

(21) Appl. No.: 13/807,735

(22) PCT Filed: Dec. 24, 2012

(86) PCT No.: PCT/CN2012/087274
§ 371 (c)(1),
(2) Date: Dec. 30, 2012

(87) PCT Pub. No.: WO2014/094322
PCT Pub. Date: Jun. 26, 2014

(65) Prior Publication Data
US 2014/0176406 A1 Jun. 26, 2014

(51) Int. Cl.
*G09G 3/36* (2006.01)

(52) U.S. Cl.
CPC ..... *G09G 3/3688* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 5,801,673 | A | 9/1998 | Shimada et al. | |
| 6,388,724 | B1 | 5/2002 | Campbell et al. | |
| 2006/0011797 | A1 | 1/2006 | Akagawa et al. | |
| 2008/0068316 | A1 * | 3/2008 | Maekawa | 345/87 |
| 2009/0174649 | A1 | 7/2009 | Kim | |
| 2013/0222437 | A1 * | 8/2013 | Ka et al. | 345/690 |

FOREIGN PATENT DOCUMENTS

| | | | |
|---|---|---|---|
| CN | 1744190 | A | 3/2006 |
| CN | 1989990 | A | 6/2007 |
| CN | 101202024 | A | 6/2008 |
| CN | 101620828 | A | 1/2010 |
| CN | 101882416 | A | 11/2010 |
| CN | 102077578 | A | 5/2011 |
| CN | 102402957 | A | 4/2012 |
| CN | 102506395 | A | 6/2012 |
| JP | H07152350 | A | 6/1995 |

OTHER PUBLICATIONS

Wang Chao, the International Searching Authority written comments, Oct. 2013, CN.
Zhang Fan, the International Searching Authority written comments, Sep. 2013, CN.

* cited by examiner

*Primary Examiner* — Joseph Haley
*Assistant Examiner* — Ifedayo Iluyomade

(57) ABSTRACT

A liquid crystal display (LCD) panel driver circuit includes a control circuit board, and an LCD panel. The LCD panel includes scan lines and data lines; the control circuit board includes a data driver module that drives the data lines. The LCD panel is configured with a switch module, and the data driver module is coupled to each of the data line via the switch module. The switch module is turned off before a drive of a last line of the scan line ends, and the switch module is turned on when a drive of the next row of the scan line starts.

13 Claims, 7 Drawing Sheets

LCD PANEL DRIVER CIRCUIT, DRIVING METHOD AND LCD DEVICE

TECHNICAL FIELD

The present disclosure relates to the field of liquid crystal displays (LCDs), and more particularly to an LCD panel driver circuit, driving method, and an LCD device.

BACKGROUND

A liquid crystal display (LCD) panel includes scan lines and data lines. The data lines are driven by a data driver module, and the scan lines are driven by a scan driver module. For a typical large size LCD panel, because length of a signal line, from the data driver module, to two ends of the LCD panel is longer than length of a signal line from the data driver module to a middle of the LCD panel, namely there is large resistance difference from a data signal output by a data driver module on a chip on film (COF) to a first row pixel of the LCD panel, there is a difference in degree in distortion when the data signal reaches the first row pixel. As shown in FIG. 1 to FIG. 3, L1 (distance from output data signal to the two ends of the LCD panel) is greater than L2 (distance output data signal to the middle of the LCD panel), a charging speed of the pixels at the two ends of the LCD panel is significantly slower than a charging speed of the pixel in the middle of the panel, and charge of all of the pixels of the panel are non-uniform, which results poor display effect of the LCD panel, and affects display quality. In particular, under color mixing image of low grayscale, such as yellow 128 grayscale, Color deviation, namely red deviation or green deviation is easy to occur at the two ends of the LCD panel of Tri-gate scan line structure. Generally, a snake-shaped line is used for compensation. However, compensation of the snake-shaped line may not sufficiently reduce impedance difference caused by distance difference, and arrangement of the snake-shaped line occupies a large area, which does not facilitate design of narrow frames.

SUMMARY

In view of the above-described problems, the aim of the present disclosure is to provide a liquid crystal display (LCD) panel driving method, an LCD panel driver circuit, and an LCD device capable of improving the display quality of a panel of large size.

The aim of the present disclosure is achieved by the following technical scheme.

An LCD panel driver circuit comprises a control circuit board, and an LCD panel that comprises scan lines and data lines. The control circuit board comprises a data driver module that drives the data lines, and a scan driver module that drives the scan lines. The data driver module is coupled to each of the data lines via a switch module, and the switch module is arranged at one end of the LCD panel adjacent to the data lines.

within each scanning period of the LCD panel, the switch module turns off a signal of the data driver module when a drive of a last row of the scan line ends and switches to a drive of a next row of the scan line, and the switch module turns on the signal of the data driver module when a preset delay time of the switch module is reached.

Furthermore, the switch module comprises controllable switches that are connected in series between the data driver module and each of the data lines, and a monitoring unit that is coupled to the control ends of each of the controllable switches. The monitoring unit comprises a delay assembly that sets the preset time.

The monitoring unit controls the controllable switches to turn off when the drive of the last row of the scan line switches to the drive of the next row of the scan line, to turn off the signal of the data driver module, and the monitoring unit controls the controllable switches to turn on when the delay assembly reaches the preset delay time, to turn on the signal of the data driver module. When the signal of data line is switched between the last row of the scan lines and the next row of the scan lines, the signal of data line at the two ends of the LCD panel may distort, namely the signal of the data line needs the certain delay time when the signal of the data line is switched from a low level to a high level, optimal effect is that the controllable switch is turned on because to avoid a maximum delay rime. Thus, the waveforms of all of the data lines can be kept consistent. The delay time can be obtained via actual measurement. However, there is difference between different LCD panels. Therefore, the optimal delay time can be set in accordance with different LCD panels by using the delay assembly 6, the delay time of an increase section of the signal of the data line can be avoided, and the signal of the data line can be given enough duration time to improve the display effect.

Furthermore, the LCD panel driver circuit comprises a timing control module, and the monitoring unit is integrated in the timing control nodule. The timing control module outputs an enable control signal that controls to switch the drive of the last row of the scan line to the next row of the scan line. The enable control signal of the timing control module is coupled to the control end of all of the controllable switches by a control line. When the drive of the last row of the scan line switches to the drive of the next row of the scan line, image signal output by the data line is switched from a last subpixel to a next subpixel. Thus, the enable control signal is used to turn on/off the controllable switch, which simplifies the control circuit and saves development cost. In addition, the square waveforms of each of the enable control signals is unchanged in general, namely the duration time of the square waveforms of each of the enable control signals is kept to be unchanged. Thus, the duration time of turning on the controllable switch each time is unchanged, effective display time of each of the subpixels is kept to be unchanged. Therefore, the charging capacities of all of the subpixel are substantially consistent, which avoids the color deviation.

Furthermore, the monitoring unit further comprises a conversion assembly that adjusts a duty ratio of the enable control signal. Generally, the enable control signal is a periodic signal of the fixed duty ratio, and the duty ratio is small, namely a duration time of a high level is short, and it is difficult to ensure the charging capacities of the pixel electrodes within the short time, in which results an abnormal display. If the conversion assembly 7 is used, the duty ratio of the enable control signal can be freely adjusted to enable the pixel electrodes to have enough charging time, which achieves a preset potential and improves the display quality.

Furthermore, the delay assembly comprise a first switch group, a second switch group, a third switch group and a fourth switch group that are connected in parallel. The first switch group comprises a first controllable switch and a second controllable switch that are connected in series, the first controllable switch is turned on at a high level, and is connected to a low-level signal, the second controllable switch is turned on at a low level, and is connected to a high-level signal. The second switch group comprises a third controllable switch and a fourth controllable switch that are connected in series, the third controllable switch is turned on at the high level, and is connected to the low-level signal, the fourth controllable switch is turned on at the low level, and is connected to the high-level signal. The third switch group comprises a fifth controllable switch and a sixth controllable switch that are connected in series, the fifth controllable switch is turned on at the high level, and is connected to the low-level signal, the sixth controllable switch is turned on at the low level, and is connected at the high-level signal. The fourth switch group comprises a seventh controllable switch and an eighth controllable switch that are connected in series; the seventh controllable switch is turned on at the high level, and is connected to the low-level signal, the eighth controllable switch is turned on at the low level, and is connected to the high-level signal. The enable control signal is coupled to a control end of the first controllable switch, and the enable control signal is coupled to a control end of the third controllable switch inversed. One end between the first controllable switch and the second controllable switch that are connected in series is coupled to a control end of the fourth controllable switch and a control end of the eighth controllable switch. One end between the third controllable switch and the fourth controllable switch that are connected in series is coupled to a control end of the second controllable switch and a control end of the sixth controllable switch. One end between the fifth controllable switch and the sixth controllable switch that are connected in series is coupled to a control end of the seventh controllable switch. One end between the seventh controllable switch and the eighth controllable switch that are connected in series is coupled to a control end of the fifth controllable switch and a control end of the control line. This is a specific structure of the conversion assembly that converts the enable control signal into a control signal of the controllable switch of the switch module. When the enable control signal is at the high level, the first controllable switch is turned on, the low-level signal is coupled to the control end of the eighth controllable switch by the first controllable switch, the eighth controllable switch is turned on, the high-level signal is coupled to the control line of the controllable switch of the switch module by the eighth controllable switch, and the switch module is turned on. When the enable control signal is at low level, the third controllable switch is turned on, the low-level signal is coupled to the control end of the sixth controllable switch by the third controllable switch, the high-level signal is coupled to the control end of the seventh controllable switch by the sixth controllable switch, the seventh controllable switch is turned on, the control line of the controllable switch of the switch module is coupled to the low-level signal by the seventh controllable switch, and the switch module is turned off.

Furthermore, the enable control signal is directly connected to the control end of the controllable switch by the control line. This is a technical scheme of directly controlling the controllable switch of the switch module by using the enable control signal, which simplifies the circuit structure, and reduces development and production cost.

Furthermore, the monitoring unit is coupled to the control ends of all of the controllable switches via a control line. The technical scheme can make that the controllable switches of all of the data lines can be simultaneously turned on/off. Thus, all of the display areas of the LCD panel can simultaneously display, which improves integrity of display image.

An LCD panel driving method, the LCD panel driver circuit comprises scan lines, data lines, and a data driver module that drives the data lines; the LCD panel driving method comprises:

A: connecting to a switch module between the data driver module and each of the data line, wherein the switch module is arranged at one end of the LCD panel adjacent to the data lines, B: within each scanning period of the LCD panel, ending a drive of to last row of the scan line, and switching to a drive of a next row of the scan line, the switch module turns off a signal of the data driver module, and the switch module turns on the signal of the data driver module when a preset delay time of the switch module is reached.

Furthermore, the switch module comprises controllable switches that are connected in series between the data driver module and each of the data lines, and a monitoring unit that is coupled to a control end of each of the controllable switches. The LCD panel driver circuit comprises a timing control module, and the monitoring unit is integrated in the timing control module. The timing control module outputs an enable control signals that controls to switch the drive of the last row of the scan line to the next row of the scan line.

The step A comprises: connecting the controllable switch of the switch module in series between the data driver module and each of the data line;

The step B comprises: coupling the enable control signal to the control end of the controllable switch, turning on the controllable switch when the enable control signal is at a high level, and turning off the controllable switch when the enable control signal is at a low level.

When the drive of the last row of the scan line switches to the drive of the next row of the scan line, the image signal output by the data line is switched from a last subpixel to a next subpixel. Thus, the enable control signal is used to turn on/off the controllable switch, which simplifies the control circuit and saves development cost. In addition, the square waveform of each of the enable control signals is unchanged in general, namely the duration time of the square waveform of each of the enable control signals is kept to be unchanged. Thus, the duration time of turning on the controllable switch each time is unchanged, and effective display time of each of subpixels is kept to be unchanged. Therefore, the charging capacities of all of the subpixels are substantially consistent, which avoids the color deviation.

A liquid crystal display (LCD) device comprises the LCD panel driver circuit of the present disclosure.

Because delay is serious when pixels at the two ends of the panel are charged, which causes that a charging speed of the pixels at the two ends of the LCD panel to be significantly slower than a charging speed of the pixels in a middle of the LCD panel, and charge of all of the pixels of the LCD panel are non-uniform, thus, display effect and display quality of the LCD panel are poor. In particular, a color deviation may occur in the LCD panel of a Tri-gate scan line structure, as shown in FIG. 2, charging capacity of a green pixel G is less than charging capacity of a red pixel R. As shown in FIG. 3, the charging capacity can be approximatively considered as an area of time corresponding to a waveform, L1 represents the waveform of the data line at the two ends of the LCD panel, where an area S2 of a red subpixel R is greater than an area S1 of a green subpixel G. Thus, display effect of the red pixel is brighter than display effect of the green pixel, and the two ends of the LCD panel are slightly red. The L2 corresponds to the waveform of the data line corresponding to the middle of the LCD panel, and the waveform of the data line do not distort. Thus, the area S1 corresponding to the green pixel is substantially consistent with the area S2 corresponding to the red pixel, thereby having no color deviation. In the present disclosure, because the switch module is used, when the signal of the data line is switched between the last row of the scan lines and the next row of the scan lines, the signal of the data line at the two ends of the LCD panel may distort, namely the signal of the data lines needs a certain delay time when the signal of the data line is switched from a low level to a high level. The signal of the data line in the middle of the LCD panel is not delayed, and the switch module is turned off before the drive of the last row of the scan line ends, and is turned on after the drive of the next row of the scan line starts, which may avoid the delay time partially or completely. Therefore, the waveforms of the data lines actually reaching are kept to be square waveforms, namely no matter in the middle or at the two ends of the LCD panel, the waveforms of the data lines actually reaching are basically kept to be consistent, the charging capabilities of the pixels at the two ends and in the middle of the panel are basically kept to be consistent, which increases display quality. In particular, for the LCD panel of the Tri-gate scan line structure, the charging capacities of the pixel electrodes corresponding to different colors are kept to be consistent basically, and the color deviation is reduced. The present disclosure is applicable to the LCD panel of various structures, and more particularly applicable to LCD panels of the Tri-gate scan line structure.

Legends: 1. data driver module: 2. switch module; 3. scan driver module; 4. tinting control module; 5. monitoring unit; 6. delay assembly; 7. conversion assembly; 8. first switch group; 9, second switch group; 10. third switch group; 11. fourth switch group.

DETAILED DESCRIPTION

The present disclosure provides a liquid crystal display (LCD) device that comprises an LCD panel driver circuit. The LCD panel driver circuit comprises a control circuit board, and an LCD panel. The LCD panel comprises scan lines and data lines. The control circuit hoard comprises a data driver module 1 that drives the data lines, and a scan driver module that drives the scan lines. The data driver module 1 is coupled to each of the data lines via a switch module 2, and the switch module 2 is arranged at one end of the LCD adjacent to the data lines.

Within each scanning period of the LCD panel, the switch module 2 turns off a signal of the data driver module 1 when a drive of a last row of the scan line ends and switches to a drive of a next row of the scan line, and the switch module 2 turns on the signal of the data driver module 1 when a preset delay time of the switch module is reached.

Figure 1:
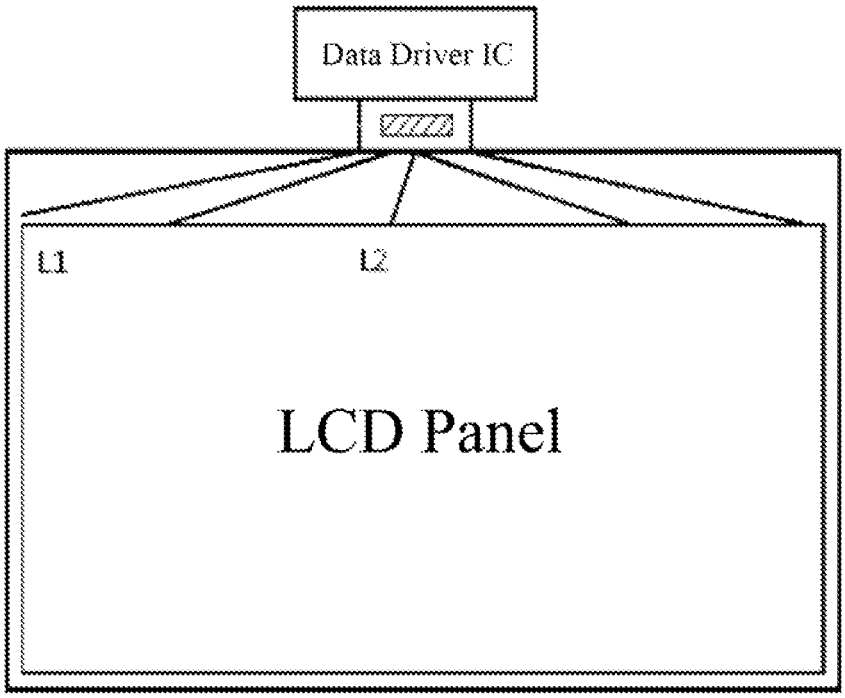
FIG. 1 is a schematic diagram of a typical liquid crystal display (LCD) panel.
Figure 2:
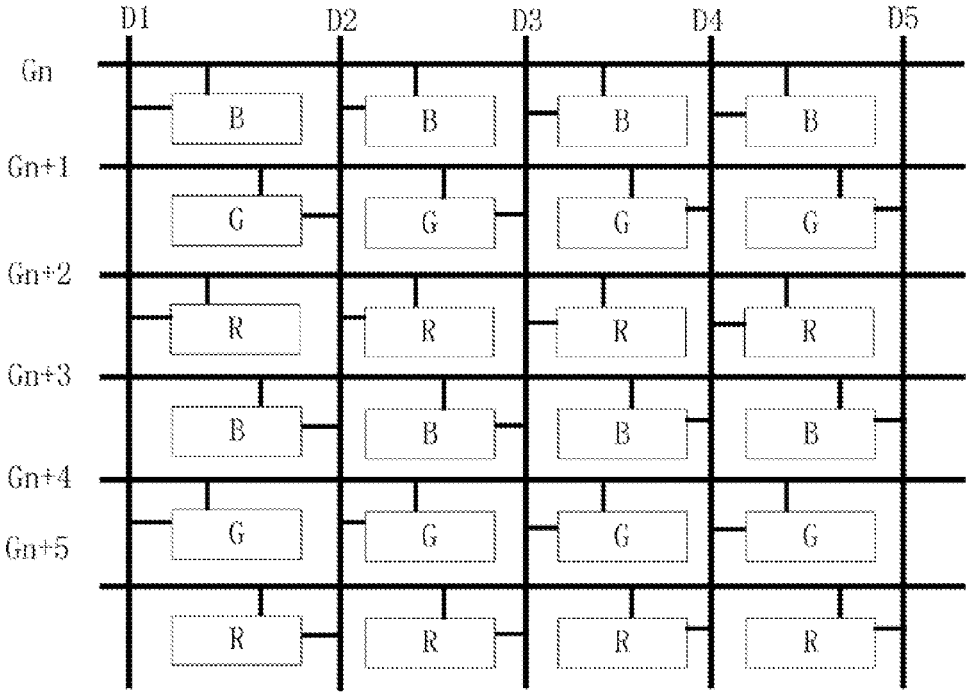
FIG. 2 is an arrangement diagram of pixels of the typical LCD panel.
Figure 3:
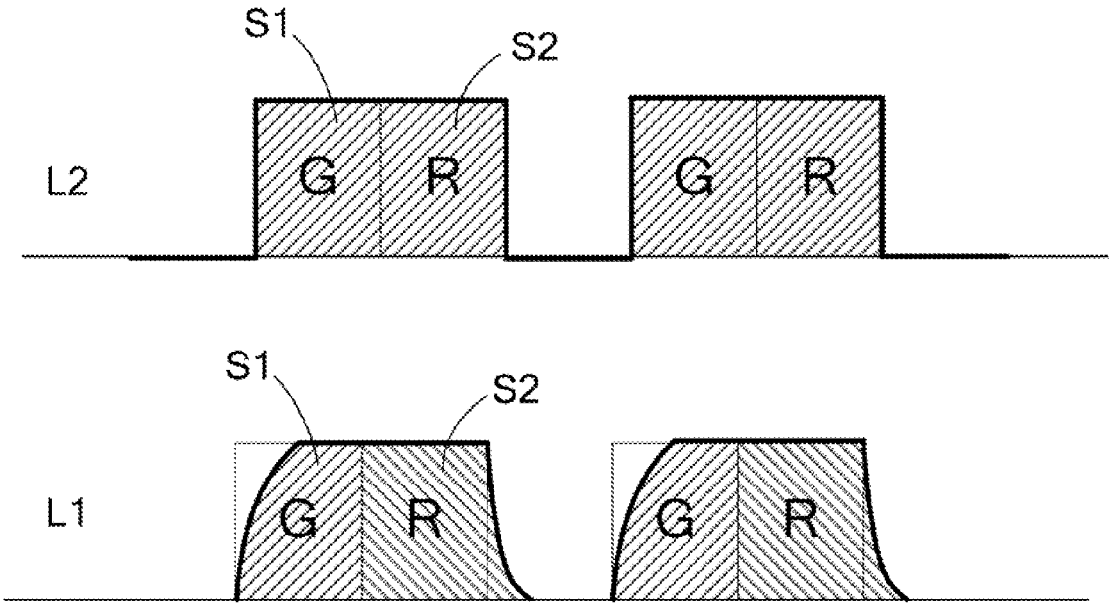
FIG. 3 is a waveform diagram of data signals of the typical LCD panel.

Because delay is serious when pixels at the two ends of the panel are charged, which causes that a charging speed of the pixels at the two ends of the LCD panel to be significantly slower than a charging speed of the pixels in a middle of the LCD panel, and charge of all of the pixels of the LCD panel are non-uniform, thus, display effect and display quality of the LCD panel are poor. In particular, a color deviation may occur in the LCD panel of a Tri-gate scan line structure, as shown in FIG. 2, charging capacity of a green pixel G is less than charging capacity of a red pixel R. As shown in FIG. 3, the charging capacity can be approximatively considered as an area of time corresponding to a waveform, L1 represents the waveform of the data line at the two ends of the LCD panel, where an area S2 of a red subpixel R is greater than an area S1 of a green subpixel G. Thus, display effect of the red pixel is brighter than display effect of the green pixel, and the two ends of the LCD panel are slightly red. The L2 corresponds to the waveform of the data line corresponding to the middle of the LCD panel, and the waveform of the data line do not distort. Thus, the area S1 corresponding to the green pixel is substantially consistent with the area S2 corresponding to the red pixel, thereby having no color deviation. In the present disclosure, because the switch module 2 is used, when the signal of the data line is switched between the last row of the scan lines and the next row of the scan lines, the signal of the data line at the two ends of the LCD panel may distort, namely the signal of the data lines needs a certain delay time when the signal of the data line is switched from a low level to a high level. The signal of the data line in the middle of the LCD panel is not delayed, and the switch module is turned off before the drive of the last row of the scan line ends, and is turned on after the drive of the next row of the scan line starts, which may avoid the delay time partially or completely. Therefore, the waveforms of the data lines actually reaching are kept to be square waveforms, namely no matter in the middle or at the two ends of the LCD panel, the waveforms of the data lines actually reaching are basically kept to be consistent, the charging capabilities of the pixels at the two ends and in the middle of the panel are basically kept to be consistent, which increases display quality. In particular, for the LCD panel of the Tri-gate scan line structure, the charging capacities of the pixel electrodes corresponding to different colors are kept to be consistent basically, and the color deviation is reduced. The present disclosure is applicable to the LCD panel of various structures, and more particularly applicable to LCD panels of the Tri-gate scan line structure.

The present disclosure will further be described in detail in accordance with the figures and the examples by using the LCD panel of the Tri-gate scan line structure as an example.

Figure 4:
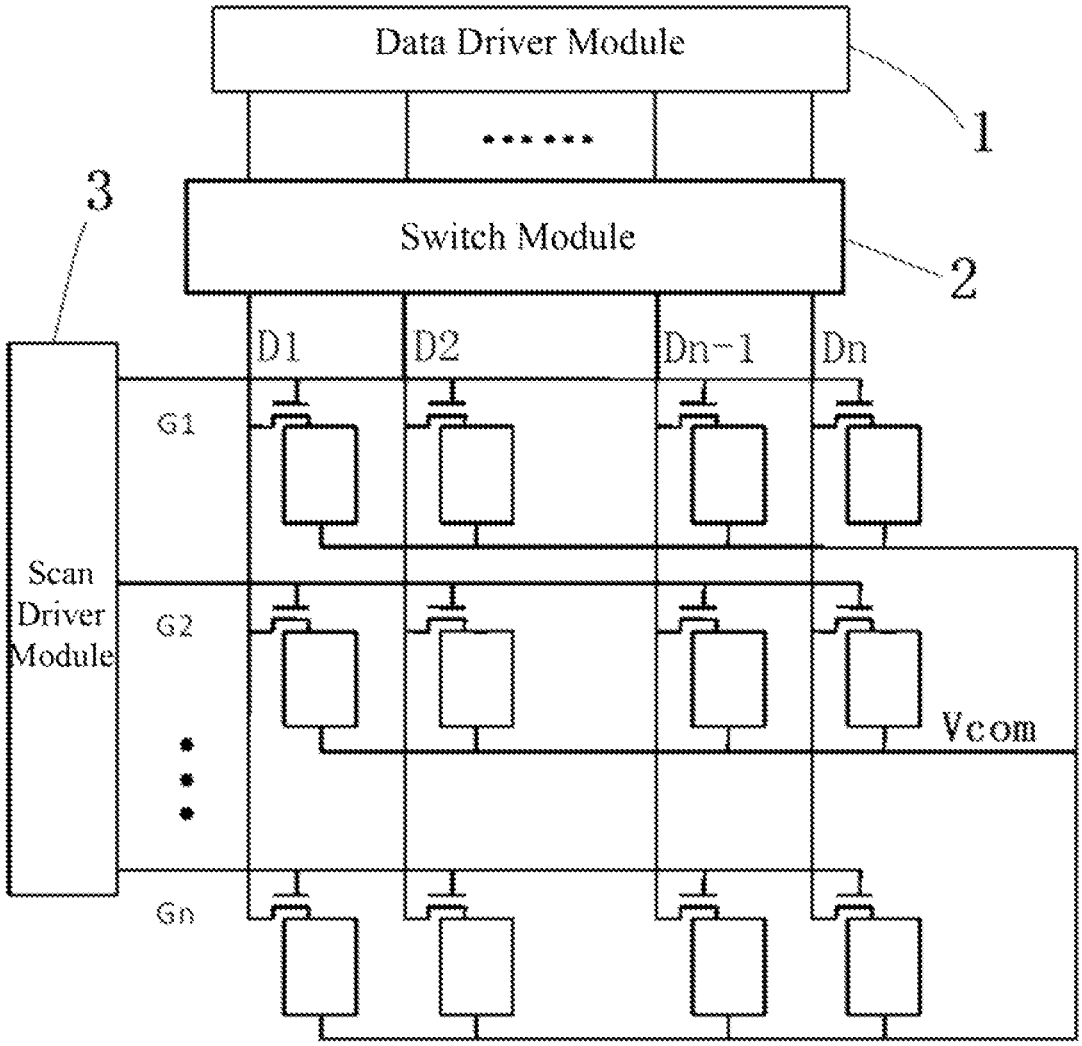
FIG. 4 is a schematic diagram of the present disclosure.
Figure 5:
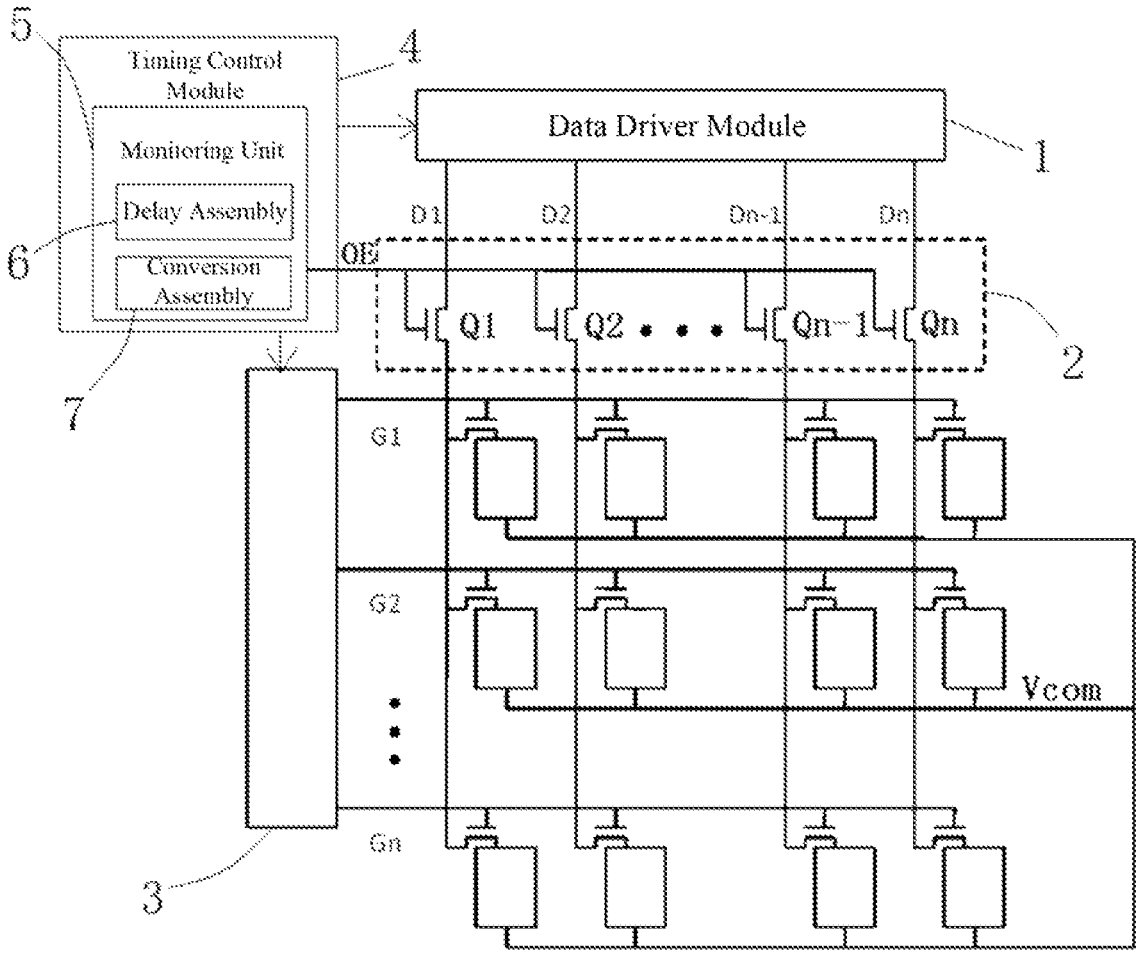
FIG. 5 is a schematic diagram of an LCD device of an example of the present disclosure.

As shown in FIG. 4 and FIG. 5, the LCD device comprises a timing control module 4, and scan lines (G1-Gn) and data lines (D1-Dn). The data lines and the scan lines cross each other. All of the scan lines are coupled to a scan driver module 3, and the scan driver module 3 drives the scan lines row by row.

The switch module 2 comprises controllable switches that are connected in series between the data driver module 1 and each of the data lines, and a monitoring unit 5 that is coupled to a control end of each of the controllable switches. The monitoring unit 5 is configured with delay assembly 6 that adjusts a time, and the monitoring unit 5 is integrated in the timing control module 4. The timing control module 4 outputs a enable control signal that controls switching of the drive of the last row of the scan line to the drive of the next row of the scan line. The enable control signal of the timing control module 4 is coupled to a control end of each of the controllable switches via a control line.

The monitoring unit 5 controls the controllable switches to turn off when the drive of the last row of the scan line switches to the drive of the next row of the scan line, to turn off the signal of the data driver module 1, and the monitoring unit 5 controls the controllable switches to turn on when the delay assembly reaches the preset delay time, to turn on the signal of the data driver module 1.

When the signal of data line is switched between the last row of the scan lines and the next row of the scan lines, the signal of data line at the two ends of the LCD panel may distort, namely the signal of the data line needs the certain delay time when the signal of the data line is switched signal from a low level to a high level, optimal effect is that the controllable switch is turned on because to avoid a maximum delay time. Thus, the waveforms of all of the data lines can be kept consistent. The delay time can be obtained via actual measurement. However, there is difference between different LCD panels. Therefore, the optimal delay time can be set in accordance with different LCD panels by using the delay assembly 6, the delay time of a increase section of the signal of the data line can be avoided, and the signal of the data line can be given enough duration time to improve the display effect.

Figure 6:
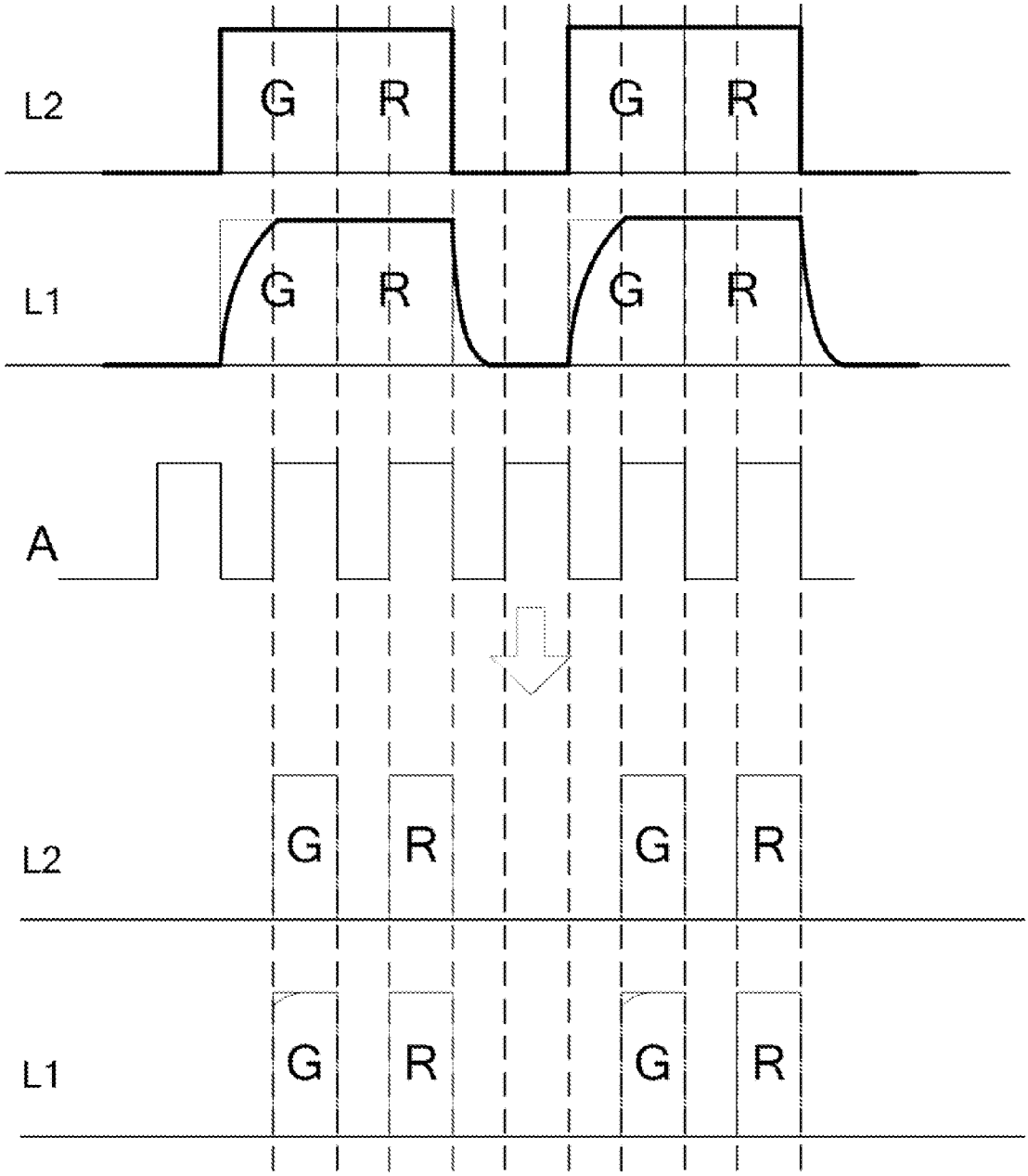
FIG. 6 is a signal waveform diagram of the present disclosure.

When the drive of the last row of the scan line switches to the drive of the next row of the scan line, image signal output by the data line is switched from a last subpixel to a next subpixel. Thus, the enable control signal is used to turn on/off the controllable switch, which simplifies the control circuit and saves development cost. In addition, the square waveforms of each of the enable control signals is unchanged in general, namely the duration time of the square waveforms of each of the enable control signals is kept to be unchanged. Thus, the duration time of turning on the controllable switch each time is unchanged, elective display time of each of the subpixels is kept to be unchanged. Therefore, the charging capacities of all of the subpixel are substantially consistent, which avoids the color deviation. FIG. 6 shows a specific driving waveform.

The monitoring unit 5 further comprises a conversion assembly 7 that adjusts a duty ratio of the enable control signal. Generally, the enable control signal is a periodic signal of the fixed duty ratio, and the duty ratio is small, namely a duration time of a high level is short, and it is difficult to ensure the charging capacities of the pixel electrodes within the short time, in which results an abnormal display. If the conversion assembly 7 is used, the duty ratio of the enable control signal can be freely adjusted to enable the pixel electrodes to have enough charging time, which achieves a preset potential and improves the display quality.

Figure 7:
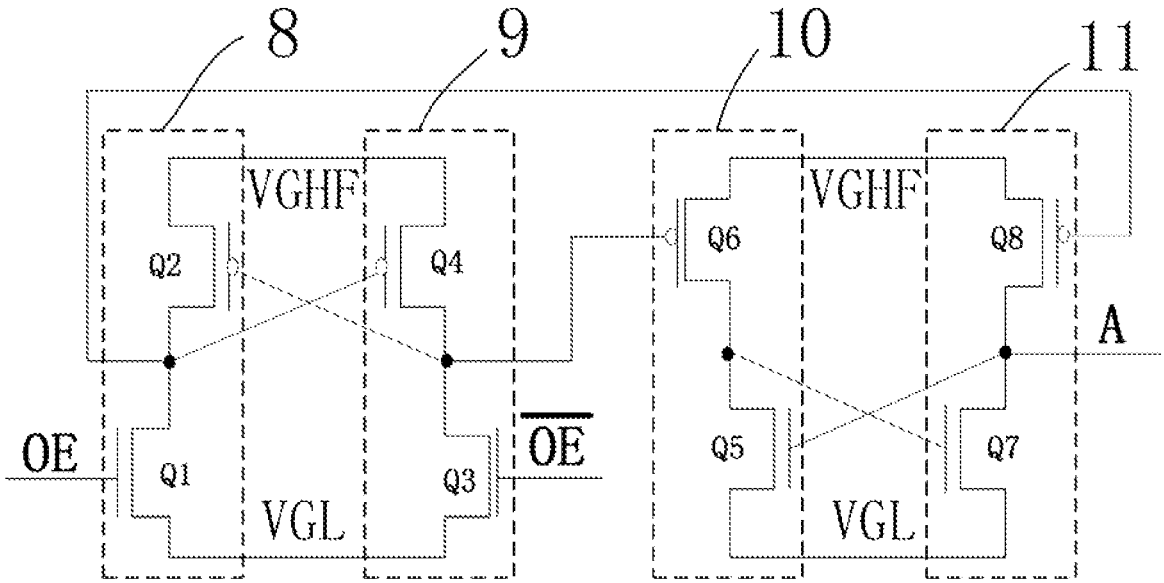
FIG. 7 is a schematic diagram of a delay assembly of the present disclosure.

As shown in FIG. 7, the delay assembly 6 comprises a first switch group 8, a second switch group 9, a third switch group 10 and a fourth switch group 11 that are connected in parallel.

The first switch group 8 comprises a first controllable switch Q1 and as second controllable switch Q2 that are connected in series. The first controllable switch Q1 is turned on at a high level, and is connected to a low-level signal VGL, the second controllable switch Q2 is turned on at a low level, and is connected to a high-level signal VGHF. The second switch group 9 comprises a third controllable switch Q3 and a fourth controllable switch Q4 that are connected in series, the third controllable switch Q3 is turned on at the high level, and is connected to the low-level signal VGL; the fourth controllable switch Q4 is turned on at the low level, and is connected to the high-level signal VGHF. The third switch group 10 comprises a fifth controllable switch Q5 and a sixth controllable switch Q6 that are connected in series. The fifth controllable switch Q5 is turned on at the high level, and is connected to the low-level signal VGL, the sixth controllable switch Q6 is turned on at the low level, and is connected to the high-level signal VGHF. The fourth switch group 11 comprises a seventh controllable switch Q7 and an eighth controllable switch Q8 that are connected in series; the seventh controllable switch Q7 is turned on at the high level, and is connected to the low-level signal VGL, the eighth controllable switch Q8 is turned on at the low level, and is connected to the high-level signal VGHF.

The enable control signal is coupled to a control end of the first controllable switch Q1, and the enable control signal is coupled to a control end of the third controllable switch inversed. One end between the first controllable switch Q1 and the second controllable switch Q2 that are connected in series is coupled to a control end of the fourth controllable switch Q4 and a control end of the eighth controllable switch Q8. One end between the third controllable switch Q3 and the second controllable switch Q4 that are connected in series is coupled to a control end of the second controllable switch Q2 and a control end of the sixth controllable switch Q6. One end between the fifth controllable switch Q5 and the sixth controllable switch Q6 that are connected in series is coupled to a control end of the seventh controllable switch Q7. One end between the seventh controllable switch Q7 and the eighth controllable switch Q8 that are connected in series is coupled to a control end of the fifth controllable switch Q5 and a control end of the control line.

The enable control signal can be converted into a control signal A of the controllable switch of the switch module by the conversion assembly. When the enable control signal OE is at the high level, the first controllable switch Q1 is turned on, the low-level signal VGL is coupled to the control end of the eighth controllable switch Q8 by the first controllable switch Q1, and the eighth controllable switch Q8 is turned on, the high-level signal VGHF is coupled to the control line of the controllable switch of the switch module by the eighth controllable switch Q8, and the switch module is turned on. When the enable control signal OE is at low level, the third controllable switch Q3 is turned on, the low-level signal VGL is coupled to the control end of the sixth controllable switch Q6 by the third controllable switch Q3, the high-level signal VGHF is coupled to the control end of the seventh controllable switch Q7 by the sixth controllable switch Q6, the seventh controllable switch Q7 is turned on, the control line of the controllable switch of the switch module is coupled to the low-level signal VGL by the seventh controllable switch Q7, and the switch module is turned off.

Optionally, the enable control signal of the present disclosure can be directly connected to the control end of the controllable switch without being delayed or converted, which simplifies the circuit structure, and reduces development and production cost.

Figure 8:
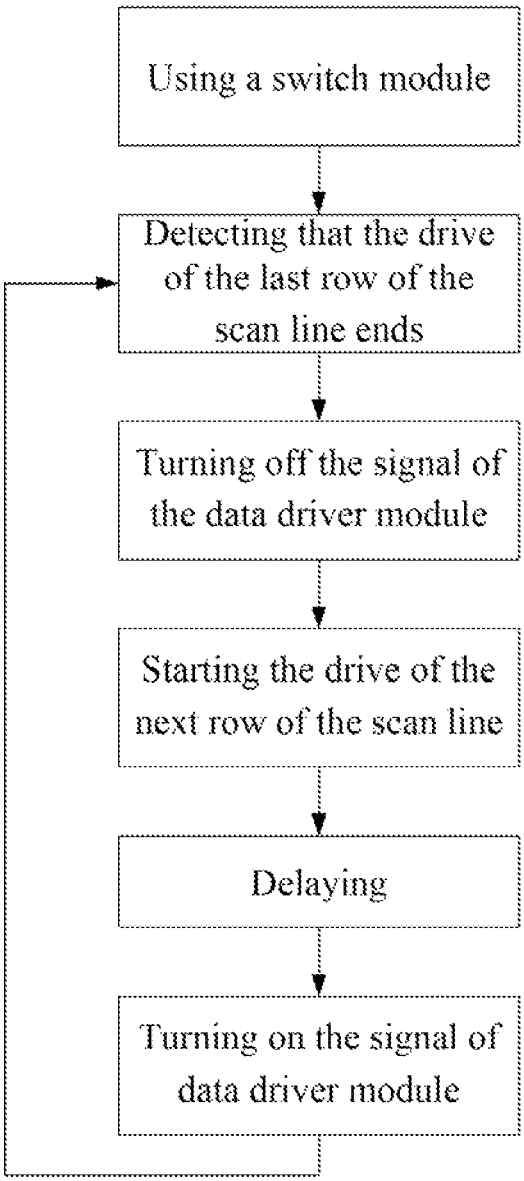
FIG. 8 is a flow diagram of a method of an example of the present disclosure.

As shown in FIG. 8, the present disclosure further provides an LCD panel driving method. The LCD panel driver circuit comprises scan lines, data lines, and a data driver module that drive the data lines. The LCD panel driving method comprises:

A: connecting to the switch module between the data driver module and each of the data lines, where the switch module is arranged at one end of the LCD panel adjacent to the data lines;

B: within each scanning period of the LCD panel, ending a drive of a last row of the scan line, and switching to a chive of a next row of the scan line. The switch module turns off a signal of the data driver module, and the switch module turns on the signal of the data driver module when a preset delay time of the switch module is reached.

Improvement can be further made in accordance with the above method. The switch module comprises controllable switches that are connected in series between the data driver module and each of the data lines, and a monitoring unit that is coupled to the control end of each of the controllable switches. The LCD panel driver circuit comprises a timing control module, and the monitoring unit is integrated in the timing control module. The timing control module outputs an enable control signal that controls to switch the drive of the last row of the scan line to the drive of the next row of the scan line. Alternatively, the step A comprises: connecting the controllable switches of the switch module between the data module and each of the data lines in series. The step B comprises: coupling the enable control signal to the control end of the controllable switch, turning on the controllable switch when the enable control signal is at the high level, and turning off the controllable switch when the enable control signal is at the low level.

When the drive of the last row of the scan line switches to the drive of the next row of the scan line, the image signal output by the data line is switched from a last subpixel to a next subpixel. Thus, the enable control signal is used to turn on/off the controllable switch, which simplifies the control circuit and saves development cost. In addition, the square waveform of each of the enable control signals is unchanged in general, namely the duration time of the square waveform of each of the enable control signals is kept to be unchanged. Thus, the duration time of turning on the controllable switch each time is unchanged, and effective display time of each of subpixels is kept to be unchanged. Therefore, the charging capacities of all of the subpixels are substantially consistent, which avoids the color deviation.

The present disclosure is described in detail in accordance with the above preferred examples. However, this present disclosure is not limited to the preferred examples. On the premise of keeping the conception and the scope of the present disclosure, all modifications, equivalent replacements and improvements, etc. should be considered to belong to the protection scope of the present disclosure.

The invention claimed is:

1. A liquid crystal display (LCD) panel driver circuit, comprising: a control circuit board; and an LCD panel that comprises scan lines and data lines; wherein the control circuit board comprises a data driver module that drives the data lines, and a scan driver module that drives the scan lines; the data driver module is coupled to each of the data lines via a switch module, and the switch module is arranged at one end of the LCD panel adjacent to the data lines; within each scanning period of the LCD panel, the switch module turns off a signal of the data driver module when a drive of a last row of the scan line ends and switches to a drive of a next row of the scan line, and the switch module turns on the signal of the data driver module when a preset delay time of the switch module is reached, wherein the switch module comprises controllable switches that are connected in series between the data driver module and each of the data lines, and a monitoring unit that is coupled to the control ends of each of the controllable switches; the monitoring unit comprises a delay assembly that sets the preset time; wherein the monitoring unit controls the controllable switches to turn off when the drive of the last row of the scan line switches to the drive of the next row of the scan line, to turn off the signal of the data driver module, and the monitoring unit controls the controllable switches to turn on when the delay assembly reaches the preset delay time, to turn on the signal of the data driver module, and wherein charging capacities of pixel electrodes of the LCD panel corresponding to different colors are kept consistent.

2. The LCD panel driver circuit of claim 1, wherein the LCD panel driver circuit further comprises a timing control module, and the monitoring unit is integrated in the timing control module; the timing control module outputs an enable control signal that controls to switch the drive of the last row of the scan line to the next row of the scan line; the enable control signal of the timing control module is coupled to the control end of all of the controllable switches by a control line.

3. The LCD panel driver circuit of claim 2, wherein the monitoring unit further comprises a conversion assembly that adjusts a duty ratio of the enable control signal.

4. The LCD panel driver circuit of claim 2, wherein the delay assembly comprises a first switch group, a second switch group, a third switch group, and a fourth switch group that are connected in parallel;

wherein the first switch group comprises a first controllable switch and a second controllable switch that are connected in series; the first controllable switch is turned on at a high level, and is connected to a low-level signal; the second controllable switch is turned on at a low level, and is connected to a high-level signal; the second switch group comprises a third controllable switch and a fourth controllable switch that are connected in series; the third controllable switch is turned on at the high level, and is connected to the low-level signal; the fourth controllable switch is turned on at the low level, and is connected to the high-level signal; the third switch group comprises a fifth controllable switch and a sixth controllable switch that are connected in series; the fifth controllable switch is turned on at the high level, and is connected to the low-level signal; the sixth controllable switch is turned on at the low level, and is connected at the high-level signal; the fourth switch group comprises a seventh controllable switch and an eighth controllable switch that are connected in series; the seventh controllable switch is turned on at the high level, and is connected to the low-level signal; the eighth controllable switch is turned on at the low level, and is connected to the high-level signal;

wherein the enable control signal is coupled to a control end of the first controllable switch, and the enable control signal is coupled to a control end of the third controllable switch inversed; one end between the first controllable switch and the second controllable switch that are connected in series is coupled to a control end of the fourth controllable switch and a control end of the eighth controllable switch; one end between the third controllable switch and the fourth controllable switch that are connected in series is coupled to a control end of the second controllable switch and a control end of the sixth controllable switch; one end between the fifth controllable switch and the sixth controllable switch that are connected in series is coupled to a control end of the seventh controllable switch; one end between the seventh controllable switch and the eighth controllable switch that are connected in series is coupled to a control end of the fifth controllable switch and a control end of the control line.

5. The LCD panel driver circuit of claim 2, wherein the enable control signal is directly connected to the control end of the controllable switch via the control line.

6. The LCD panel driver circuit of claim 1, wherein the monitoring unit is coupled to the control ends of all of the controllable switches via a control line.

7. A liquid crystal display (LCD) panel driving method, wherein the LCD panel driver circuit comprising scan lines, data lines, and a data driver module that drives the data lines; the LCD panel driving method comprises: A: connecting to a switch module between the data driver module and each of the data line, wherein the switch module is arranged at one end of the LCD panel adjacent to the data lines; B: within each scanning period of the LCD panel, ending a drive of a last row of the scan line, and switching to a drive of a next row of the scan line, the switch module turns off a signal of the data driver module, and the switch module turns on the signal of the data driver module when a preset delay time of the switch module is reached, wherein the switch module comprises controllable switches that are connected in series between the data driver module and each of the data lines, and a monitoring unit that is coupled to a control end of each of the controllable switches; the LCD panel driver circuit comprises a timing control module, and the monitoring unit is integrated in the timing control module; the timing control module outputs an enable control signals that controls to switch the drive of the last row of the scan line to the next row of the scan line; the step A comprises: connecting the controllable switch of the switch module in series between the data driver module and each of the data lines; the step B comprises: coupling the enable control signal to a control end of the controllable switch, turning on the controllable switch when the enable control signal is at a high level, and turning off the controllable switch when the enable control signal is at a low level, and wherein charging capacities of pixel electrodes of the LCD panel corresponding to different colors are kept consistent.

8. A liquid crystal display (LCD) device, comprising: an LCD panel driver circuit, wherein the LCD panel driver circuit comprises a control circuit board, and an LCD panel; the LCD panel comprises scan lines and data lines; the control circuit board comprises a data driver module that drives the data lines, and a scan driver module that drives the scan lines; the data driver is coupled to each of the data lines via a switch module, and the switch module is arranged at one end of the LCD panel adjacent to the data lines; within each scanning period of the LCD panel, the switch module turns off a signal of the data driver module when a drive of a last row of the scan line ends and switches to a drive of a next row of the scan line, and the switch module turns on the signal of the data driver module when a preset delay time of the switch module is reached, wherein the switch module comprises controllable switches that are connected in series between the data driver module and each of the data lines, and a monitoring unit that is coupled to the control ends of each of controllable switches; the monitoring unit comprises a delay assembly that sets the preset time; wherein the monitoring unit controls the controllable switches to turn off when the drive of the last row of the scan line switches to the drive of the next row of the scan line, to turn off the signal of the data driver module, and the monitoring unit controls the controllable switches to turn on when the delay assembly reaches the preset delay time, to turn on the signal of the data driver module, and wherein charging capacities of pixel electrodes of the LCD panel corresponding to different colors are kept consistent.

9. The LCD device of claim 8, wherein the LCD panel driver circuit comprises a timing control module, and the monitoring unit is integrated in the timing control module; the timing control module outputs an enable control signal that controls to switch the drive of the last row of the scan line to the next row of the scan line; the enable control signal of the timing control module is coupled to the control end of all of the controllable switches by a control line.

10. The LCD device of claim 9, wherein the monitoring unit further comprises a conversion assembly that adjusts a duty ratio of the enable control signal.

11. The LCD device of claim 9, wherein the delay assembly comprises a first switch group, a second switch group, a third switch group and a fourth switch group that are connected in parallel;

wherein the first switch group comprises a first controllable switch and a second controllable switch that are connected in series; the first controllable switch is turned on at a high level, and is connected to a low-level signal; the second controllable switch is turned on at a low level, and is connected to a high-level signal; the second switch group comprises a third controllable switch and a fourth controllable switch that are connected in series; the third controllable switch is turned on at the high level, and is connected to the low-level signal; the fourth controllable switch is turned on at the low level, and is connected to the high-level signal; the third switch group comprises a fifth controllable switch and a sixth controllable switch that are connected in series; the fifth controllable switch is turned on at the high level, and is connected to the low-level signal; the sixth controllable switch is turned on at the low level, and is connected at the high-level signal; the fourth switch group comprises a seventh controllable switch and an eighth controllable switch that are connected in series; the seventh controllable switch is turned on at the high level, and is connected to the low-level signal; the eighth controllable switch is turned on at the low level, and is connected to the high-level signal;

wherein the enable control signal is coupled to a control end of the first controllable switch, and the enable control signal is coupled to a control end of the third controllable switch inversed; one end between the first controllable switch and the second controllable switch that are connected in series is coupled to a control end of the fourth controllable switch and a control end of the eighth controllable switch; one end between the third controllable switch and the fourth controllable switch that are connected in series is coupled to a control end of the second controllable switch and a control end of the sixth controllable switch; one end between the fifth controllable switch and the sixth controllable switch that are connected in series is coupled to a control end of the seventh controllable switch; one end between the seventh controllable switch and the eighth controllable switch that are connected in series is coupled to a control end of the fifth controllable switch and a control end of the control line.

12. The LCD device of claim 9, wherein the enable control signal is directly connected to control end of the controllable switch via the control line.

13. The LCD device of claim 8, wherein the monitoring unit is coupled to the control ends of all of the controllable switches by a control line.

* * * * *